US008281757B2

(12) United States Patent
Tomimatsu et al.

(10) Patent No.: US 8,281,757 B2
(45) Date of Patent: Oct. 9, 2012

(54) VARIABLE VALVE TRAIN CONTROL DEVICE

(75) Inventors: Makoto Tomimatsu, Susono (JP); Nobuhiko Koga, Aichi-gun (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 459 days.

(21) Appl. No.: 12/669,043

(22) PCT Filed: Jun. 20, 2008

(86) PCT No.: PCT/JP2008/061683

§ 371 (c)(1),
(2), (4) Date: Jan. 14, 2010

(87) PCT Pub. No.: WO2009/011212

PCT Pub. Date: Jan. 22, 2009

(65) Prior Publication Data

US 2010/0192886 A1 Aug. 5, 2010

(30) Foreign Application Priority Data

Jul. 18, 2007 (JP) ..... 2007-186826

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

| | | | | |
|---|---|---|---|---|
| 5,184,578 | A | 2/1993 | Quinn, Jr. et al. | |
| 5,218,935 | A * | 6/1993 | Quinn et al. | 123/90.17 |
| 5,603,237 | A | 2/1997 | Bohman et al. | |
| 6,755,165 | B2 | 6/2004 | Kondou et al. | |
| 2003/0164149 | A1 | 9/2003 | Kondou et al. | |
| 2003/0196618 | A1 | 10/2003 | Simpson | |
| 2007/0028874 | A1 | 2/2007 | Simpson | |

FOREIGN PATENT DOCUMENTS

| | | |
|---|---|---|
| EP | 0 738 586 | 10/1996 |
| EP | 1 340 887 | 9/2003 |
| JP | 10 98911 | 4/1998 |
| JP | 10 227235 | 8/1998 |
| JP | 11 2142 | 1/1999 |
| JP | 11 236831 | 8/1999 |
| JP | 2000 60217 | 2/2000 |
| JP | 2002 295526 | 10/2002 |

(Continued)

*Primary Examiner* — Zelalem Eshete
(74) *Attorney, Agent, or Firm* — Oblon, Spivak, McClelland, Maier & Neustadt, L.L.P.

(57) ABSTRACT

The oil pressure for a hydraulic actuator (60) of a variable valve train (52,54) is controlled in accordance with a duty value of a control signal for a hydraulic control valve (66,68). When predetermined inching control execution conditions are established, inching control in which the duty value is varied in a pulsed manner between a retention duty value, which retains an operation of the hydraulic actuator, and a forced drive duty value, which forcibly drives the hydraulic actuator, is exercised instead of duty value feedback control in which the duty value is calculated in accordance with the deviation between an actual valve opening characteristic and a target valve opening characteristic. If the oil temperature is lower than a predetermined temperature, inching control is exercised to ensure that the first pulse width generated after the start of inching control is wider than normal.

6 Claims, 7 Drawing Sheets

FOREIGN PATENT DOCUMENTS

| | | |
|---|---|---|
| JP | 2002 310103 | 10/2002 |
| JP | 2003 254017 | 9/2003 |
| JP | 2005 12900 | 1/2005 |
| JP | 2005 112516 | 4/2005 |
| JP | 2006 170011 | 6/2006 |
| JP | 2006 244230 | 9/2006 |
| WO | 01 27478 | 4/2001 |

* cited by examiner

Deviation evtexer

| Engin speed NE | 0 | 10 | 20 |
|---|---|---|---|
| 0 | 0 | 8 | 32 |
| 1600 | 0 | 8 | 32 |
| 3200 | 0 | 8 | 32 |

VARIABLE VALVE TRAIN CONTROL DEVICE

TECHNICAL FIELD

The present invention relates to a variable valve train control device.

BACKGROUND ART

A variable valve train that uses a hydraulic actuator to vary the valve opening characteristic of intake and exhaust valves of an internal combustion engine is widely used. For example, there is a known variable valve timing mechanism, which includes a hydraulic actuator for rotating a camshaft relative to a timing gear and varies the valve open/close timing while maintaining a fixed operating angle (valve opening period).

A common method of controlling the above variable valve train is to exercise feedback control over a duty value of a control signal for a hydraulic control valve, which controls the oil pressure acting on the hydraulic actuator, in accordance with a deviation between a target valve opening characteristic and an actual valve opening characteristic.

However, when, for instance, oil is low in temperature and high in viscosity (when the engine is cold) or when the oil is deteriorated, the oil flow resistance in a hydraulic circuit and the friction resistance of each slide member increase. This may readily exert an adverse effect on the motions of the hydraulic actuator and hydraulic control valve. As a result, the responsiveness of the variable valve train may decrease. Thus, the following conventional technologies are proposed to solve the above problem.

When oil temperature is lower than a normal temperature region, a technology disclosed in JPA-2006-244230 ensures that the frequency of a pulse width modulated signal, which is a control signal for a hydraulic control valve, is lower than a normal frequency.

When there is a great deviation between the target valve opening characteristic and actual valve opening characteristic at a low oil temperature, a technology disclosed in JP-A-2003-254017 does not exercise feedback control over a control signal duty value for a hydraulic control valve, but exercises inching control so that an operation for keeping the duty value at a forced drive duty value (e.g., 100% or 0%) for a predetermined period of time is repeatedly performed at predetermined time intervals.

[Patent Document 1] JP-A-2006-244230
[Patent Document 2] JP-A-2003-254017
[Patent Document 3] JP-A-2006-170011
[Patent Document 4] JP-A-10-227235
[Patent Document 5] JP-A-11-236831
[Patent Document 6] JP-A-11-2142

DISCLOSURE OF THE INVENTION

Problem to be Solved by the Invention

Inching control, which is described above, effectively improves the responsiveness of a variable valve train at a low oil temperature or during the use of deteriorated oil because it can maintain the forced drive duty value for a predetermined period of time to supply oil to a hydraulic actuator at a high flow rate.

According to the findings of the inventor of the present invention, it is important for further improvement of responsiveness that the hydraulic actuator promptly start moving. Further, the promptness of the initial movement of the hydraulic actuator is greatly affected by the period of time (hereinafter referred to as the "initial pulse width") during which the duty value is initially maintained at the forced drive duty value during inching control.

However, if the initial pulse width is fixed, the promptness of the initial movement of the hydraulic actuator might not sufficiently increase when, for instance, the oil temperature is especially low. If, for instance, low-viscosity oil is used by contraries, the hydraulic actuator might move excessively and overshoot a target value.

The present invention has been made in view of the above circumstances. An object of the present invention is to provide a variable valve train control device that is capable of promptly converging an actual valve opening characteristic to a target valve opening characteristic no matter whether, for instance, the temperature is low.

Means for Solving the Problem

First aspect of the present invention is a variable valve train control device comprising:

a variable valve train which uses a hydraulic actuator to vary the valve opening characteristic of an intake valve or an exhaust valve of an internal combustion engine;

oil temperature acquisition means for detecting or estimating an oil temperature;

a hydraulic control valve for controlling the oil pressure acting on the hydraulic actuator in accordance with a duty value of a control signal;

feedback control means for exercising duty value feedback control to calculate the duty value in accordance with a deviation between an actual valve opening characteristic and a target valve opening characteristic;

inching control means which, when predefined inching control execution conditions are established, exercises inching control instead of the duty value feedback control to vary the duty value in a pulsed manner between a retention duty value, which retains an operation of the hydraulic actuator, and a forced drive duty value, which forcibly drives the hydraulic actuator; and initial pulse extension means which, when the oil temperature is lower than a predetermined temperature, ensures that the first pulse width generated after the start of the inching control is wider than normal.

Second aspect of the present invention is the variable valve train control device according to the first aspect, further comprising:

actuator responsiveness acquisition means for acquiring a response lag between the instant at which the first pulse rises after the start of the inching control and the instant at which the hydraulic actuator starts operating, and/or an operation speed at which the hydraulic actuator operates in response to the first pulse; and initial pulse width correction means which, when the response lag is shorter than a predetermined period of time or when the operation speed is higher than a predetermined speed, interrupts or shortens an initial pulse that is set by the initial pulse extension means.

Third aspect of the present invention is the variable valve train control device according to the first or the second aspect, wherein one of the inching control execution conditions requires that the deviation be greater than a predetermined target deviation, and wherein the absolute value of a target deviation for a plus deviation differs from the absolute value of a target deviation for a minus deviation.

Fourth aspect of the present invention is the variable valve train control device according to any one of the first to the third aspects, further comprising:

limitation means which, when the oil temperature is lower than a predetermined temperature, limits the amount of operation from an initial position of the hydraulic actuator.

Advantages of the Invention

If the oil temperature is lower than the predetermined temperature when inching control is to be exercised over the variable valve train that uses the hydraulic actuator to vary the valve opening characteristic of the intake valve or exhaust valve of the internal combustion engine, the first aspect of the present invention can ensure that the width of the first pulse (initial pulse width) generated after the start of the inching control is greater than normal. Therefore, the actual valve opening characteristic can be promptly rendered close to the target valve opening characteristic even when the oil temperature is low immediately after a cold start. Further, the engine oil temperature rises after a rise in the engine water temperature. Therefore, it is practically impossible to formulate an accurate judgment when the necessity for an initial pulse width increase is to be determined in accordance with the engine water temperature. However, the first aspect of the present invention can formulate an accurate judgment because it determines the necessity for an initial pulse width increase in accordance with the engine oil temperature.

When a response lag between the instant at which the initial pulse rises and the instant at which the hydraulic actuator starts operating is shorter than the predetermined period of time or when the acquired operation speed at which the hydraulic actuator operates in response to the initial pulse is higher than the predetermined speed, the second aspect of the present invention can interrupt or shorten the extended initial pulse. If the initial pulse width is increased, for instance, during the use of low-viscosity oil, the hydraulic actuator might move excessively and cause the actual valve opening characteristic to overshoot the target valve opening characteristic. However, the second aspect of the present invention can absolutely avoid such an overshoot.

According to the third aspect of the present invention, one of the inching control execution conditions requires that the deviation between the target valve opening characteristic and actual valve opening characteristic be greater than the predetermined target deviation. Further, the absolute value of the target deviation for a plus deviation differs from the absolute value of the target deviation for a minus deviation. The third aspect of the present invention can absolutely avoid hunting in which the control mode first changes from inching control to feedback control as the actual valve opening characteristic comes close to the target valve opening characteristic and then changes from feedback control to inching control as the actual valve opening characteristic overshoots the target valve opening characteristic.

When the oil temperature is lower than the predetermined temperature, the fourth aspect of the present invention can limit the amount of operation from the initial position of the hydraulic actuator. Therefore, the hydraulic actuator can be returned to the initial position with increased certainty before the engine oil pressure lowers during engine inactivity no matter whether the oil temperature is low.

BEST MODE FOR CARRYING OUT THE INVENTION

First Embodiment

[Description of System Configuration]

Figure 1:
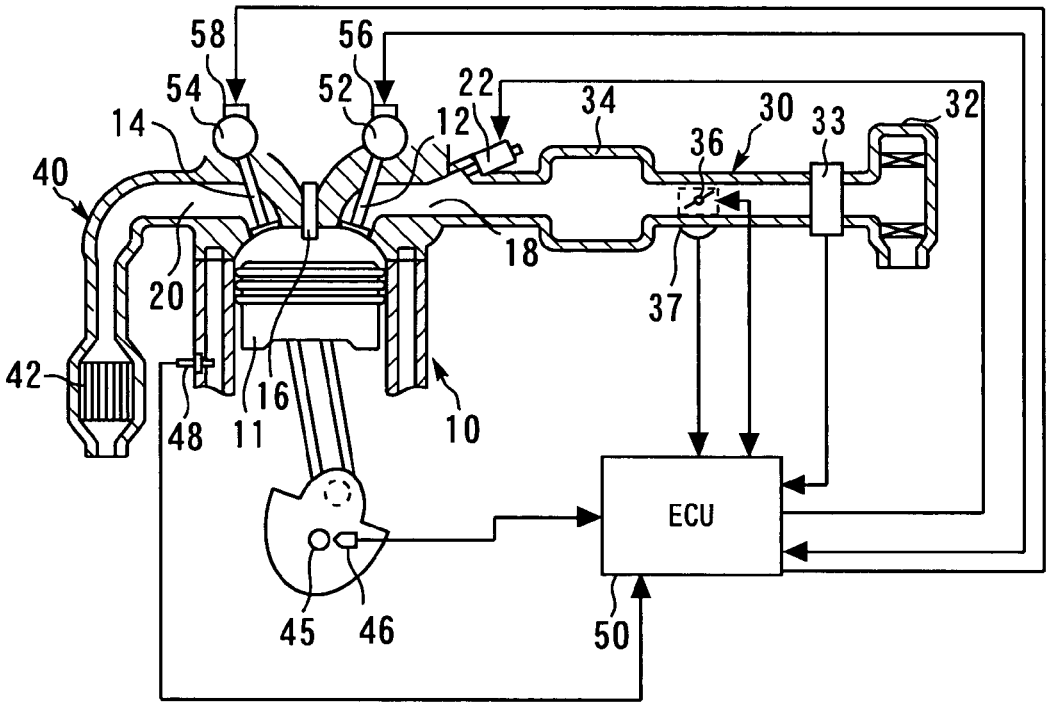
FIG. 1 shows the configuration of a system according to a first embodiment of the present invention.

FIG. 1 shows the configuration of a system according to a first embodiment of the present invention. As shown in FIG. 1, the system according to the first embodiment of the present invention includes an internal combustion engine 10.

Each cylinder in the internal combustion engine 10 has a piston 11, an intake valve 12, an exhaust valve 14, an ignition plug 16, an intake port 18, and an exhaust port 20. The intake port 18 and exhaust port 20 communicate with the interior of the cylinder.

Each cylinder in the internal combustion engine 10 also has a fuel injector 22, which injects fuel into the intake port 18. The intake port 18 communicates with an intake path 30. An air cleaner 32 is installed at an upstream end of the intake path 30. Air is taken into the intake path 30 through the air cleaner 32.

An air flow meter 33 is positioned downstream of the air cleaner 32. The air flow meter 33 is a sensor that detects the amount of intake air GA that flows in the intake path 30. The use of the air flow meter 33 makes it possible to calculate, for instance, the load rate eklsm of the internal combustion engine 10.

The downstream portion of the intake path 30 is branched at a branch section and connected to the intake port 18 of each cylinder. A surge tank 34 is mounted on the branch section. A throttle valve 36 is positioned upstream of the surge tank 34 for the intake path 30. The throttle valve 36 has a throttle position sensor 37, which detects the opening of the throttle valve 36.

The exhaust port 20 is connected to an exhaust path 40. A catalyst 42 is installed in the exhaust path 40 to purify exhaust gas.

A crank angle sensor 46 is installed near a crankshaft 45 of the internal combustion engine 10 to detect the rotational position (crank angle) of the crankshaft 45. Further, a water temperature sensor 48 is installed in the internal combustion engine 10 to detect the temperature of engine cooling water.

The internal combustion engine 10 also includes an intake variable valve train 52, which varies the valve timing of the intake valve 12 by changing the phase of an intake cam, and an exhaust variable valve train 54, which varies the valve timing of the exhaust valve 14 by changing the phase of an exhaust cam. An intake cam angle sensor 56 is installed near an intake camshaft. The use of the intake cam angle sensor 56 makes it possible to detect the actual valve timing of the intake valve 12. Similarly, an exhaust cam angle sensor 58 is installed near an exhaust camshaft. The use of the exhaust cam angle sensor 58 makes it possible to detect the actual valve timing of the exhaust valve 14.

The system according to the present embodiment includes an ECU (Electronic Control Unit) 50. The ECU 50 is electrically connected to the various sensors and actuators described above. The ECU 50 can control the internal combustion engine 10 by regulating the operations of the actuators in accordance with the outputs of the sensors.

Figure 2:
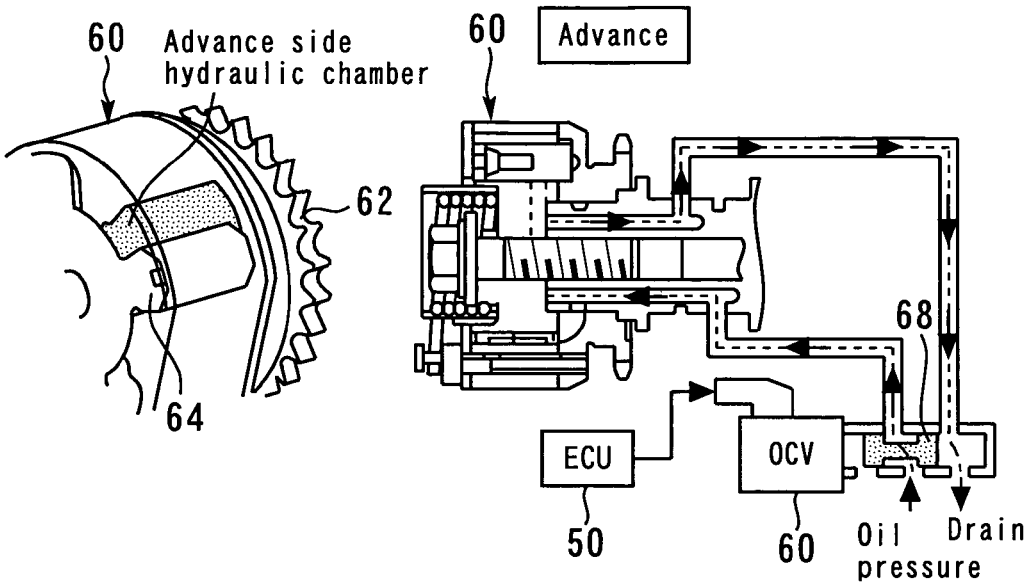
FIG. 2 is a diagram showing the operations of an exhaust variable valve train.
Figure 3:
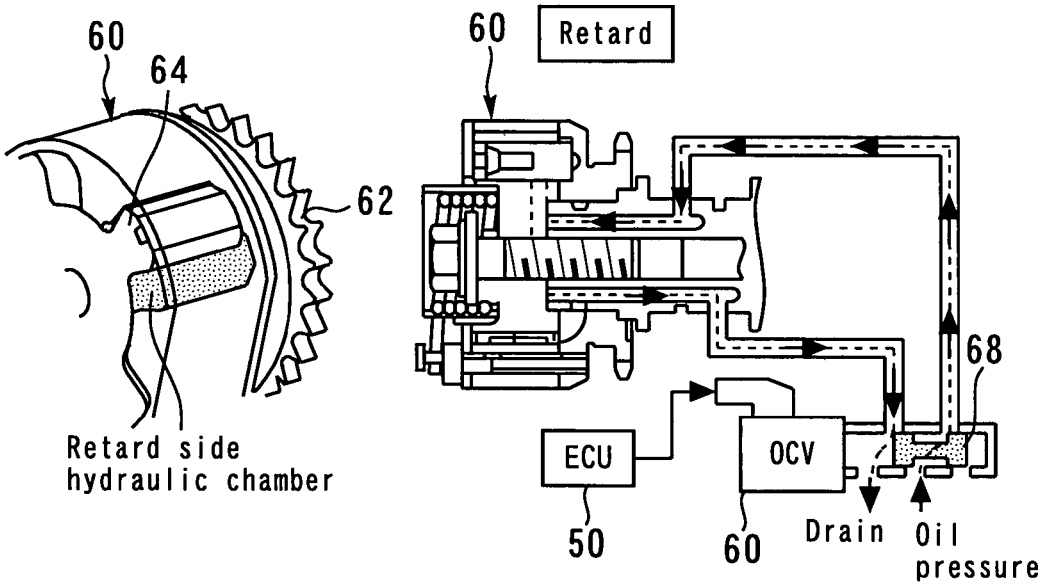
FIG. 3 is a diagram showing the operations of an exhaust variable valve train.
Figure 4:
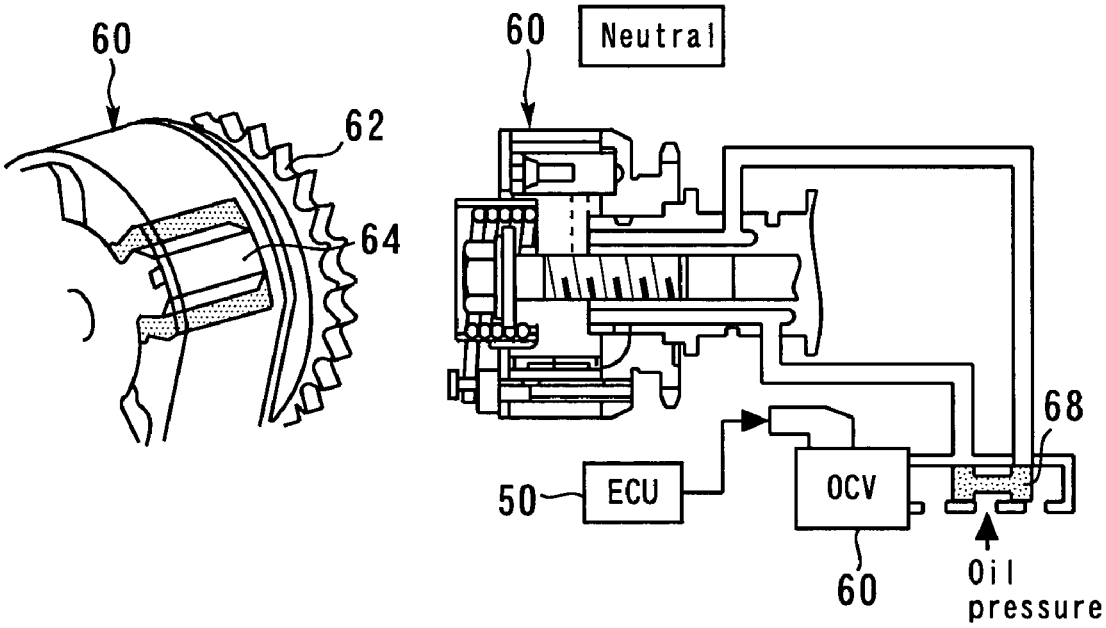
FIG. 4 is a diagram showing the operations of an exhaust variable valve train.

FIGS. 2 to 4 are diagrams showing the operations of the exhaust variable valve train 54. The present embodiment is described on the assumption that the present invention is applied to the control of the exhaust variable valve train 54. However, the present invention can also be similarly applied to the intake variable valve train 52.

As shown in FIG. 2, the exhaust variable valve train 54 includes a hydraulic actuator 60. The housing for the hydraulic actuator 60 is fastened to a timing gear 62, which is rotary driven by the crankshaft 45 of the internal combustion engine 10 via a chain and the like. On the other hand, a vane 64 of the hydraulic actuator 60 is fastened to the exhaust camshaft (not shown). This enables the hydraulic actuator 60 to rotate the exhaust camshaft relative to the timing gear 62.

The oil pressure acting on the hydraulic actuator 60 is controlled by a hydraulic control valve (OCV) 66, which is made of a linear solenoid valve. A spool valve 68 for the hydraulic control valve 66 is pressed leftward in FIG. 2 by a spring (not shown). The duty value of a control signal applied to the hydraulic control valve 66 (hereinafter referred to as the "OCV duty value") is controlled by the ECU 50. The spool valve 68 controls the oil pressure acting on the hydraulic actuator 60 when it moves in accordance with the OCV duty value.

When the spool valve 68 is positioned as shown in FIG. 2, oil pressure is supplied to an advance side hydraulic chamber of the hydraulic actuator 60. As a result, the vane 64 rotates in an advancing direction relative to the timing gear 62 to advance the valve timing of the exhaust valve 14.

When, on the other hand, the spool valve 68 is positioned as shown in FIG. 3, oil pressure is supplied to a retard side hydraulic chamber of the hydraulic actuator 60. As a result, the vane 64 rotates in a retarding direction relative to the timing gear 62 to retard the valve timing of the exhaust valve 14.

If the spool valve 68 is positioned as shown in FIG. 4, however, the path for supplying oil pressure to the hydraulic actuator 60 closes. This brings the hydraulic actuator 60 to an immediate stop. It means that the current valve timing of the exhaust valve 14 is retained.

When a retention duty value (50% in the present embodiment) is employed as the OCV duty value edvtex, the spool valve 68 is positioned as shown in FIG. 4 to retain the valve timing of the exhaust valve 14. When, on the other hand, the OCV duty value edvtex comes close to 0%, the biasing force of the spring moves the spool valve 68 closer to the position shown in FIG. 2. Therefore, the hydraulic actuator 60 can be rotated in an advancing direction at an increased speed. Conversely, when the OCV duty value edvtex comes close to 100%, the spool valve 68 comes closer to the position shown in FIG. 3 against the biasing force of the spring. Therefore, the hydraulic actuator 60 can be rotated in a retarding direction at an increased speed.

When the engine stops, the spool valve 68 moves to the position shown in FIG. 2 due to the force of the spring, thereby placing the exhaust variable valve train 54 in the most advanced state. In other words, the initial position of the exhaust variable valve train 54 represents the most advanced state. The target valve timing and actual valve timing of the exhaust variable valve train 54 are hereinafter referred to as the target value evtext [° CA] and actual opening evtex [° CA], respectively. The target value evtext and actual opening evtex respectively denote the amount of retard from the most advanced state, which represents the initial position.

[Features of First Embodiment]

Figure 5:
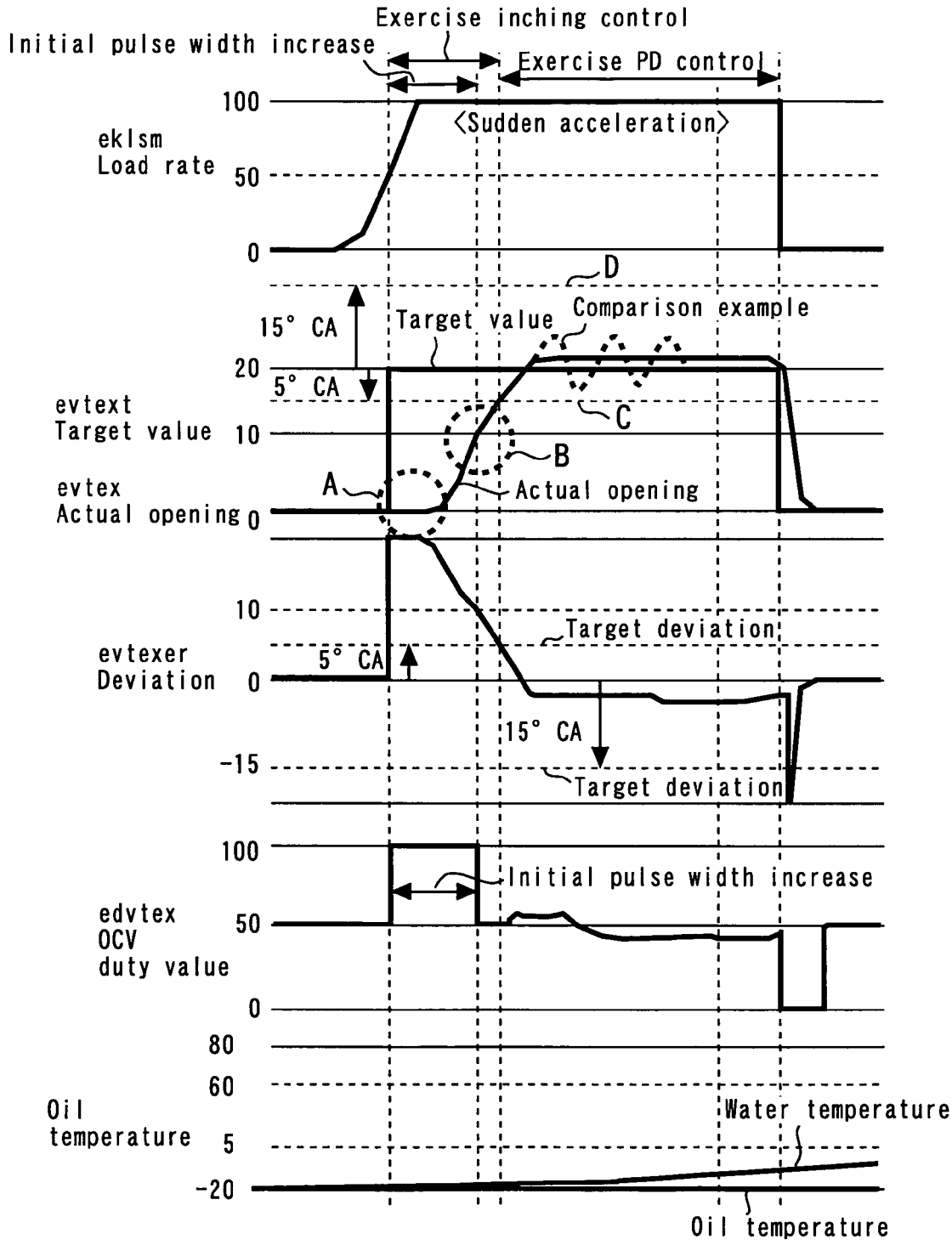
FIG. 5 is a timing diagram showing the features of the first embodiment.

FIG. 5 is a timing diagram showing the features of the first embodiment. FIG. 5 shows an example in which the internal combustion engine 10 is started when the engine water temperature and engine oil temperature are −20° C. When the deviation evtexer between the target value evtext and actual opening evtex is greater than a predetermined target deviation (5° CA on the plus side and 15° CA on the minus side in the present embodiment), the present embodiment exercises inching control so as to promptly reduce the deviation evtexer as shown in FIG. 5. Inching control is exercised to vary the OCV duty value edvtex in a pulsed manner between the retention duty value (50%) and forced drive duty value (100% and 0% in the present embodiment). A pulse used for inching control is hereinafter referred to as an "inching pulse."

When the deviation evtexer is no longer greater than the target deviation, inching control terminates. Duty value feedback control for calculating the OCV duty value edvtex in accordance with the deviation evtexer is then exercised to accurately converge the actual opening evtex to the target value evtext. In the present embodiment, duty value feedback control is a combination of P control (proportional control) and D control (derivative control). Therefore, the duty value feedback control is hereinafter referred to as "PD control."

Figures 6, 7:
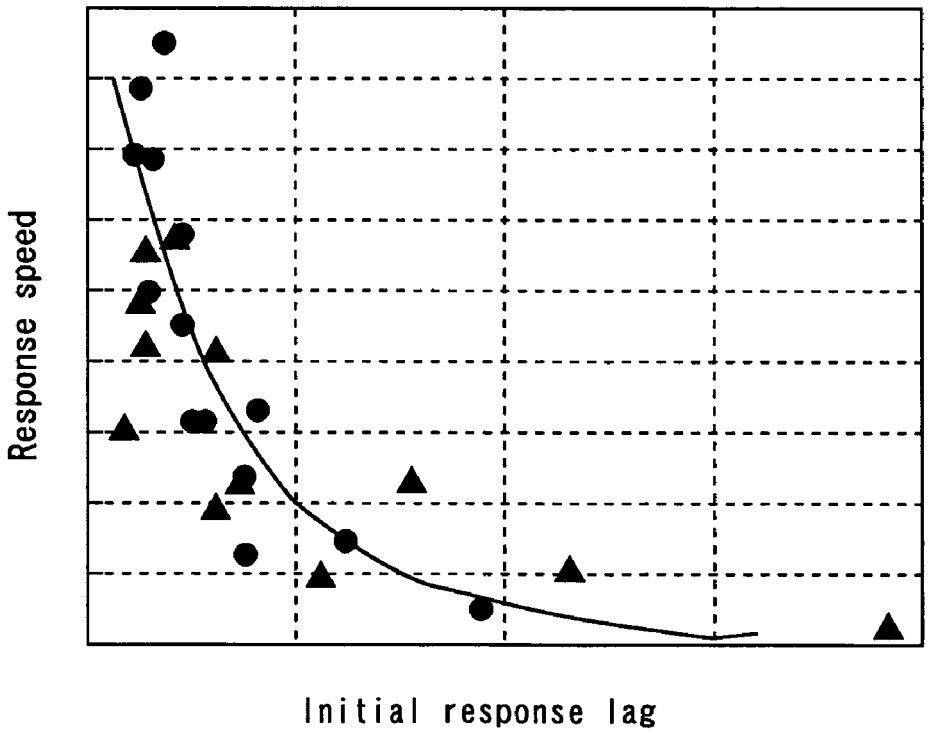
FIG. 6 shows an example of a map for calculating an inching pulse width.
FIG. 7 shows the correlation between an initial response lag and a response speed.

FIG. 6 shows an example of a map for calculating the period of time (hereinafter referred to as the "inching pulse width") during which the OCV duty value edvtex is maintained at the forced drive duty value during inching control. In principle, the inching pulse width [msec] is calculated from the engine speed NE and deviation evtexer in accordance with the map shown in FIG. 6.

However, when the engine oil temperature is particularly low, the oil viscosity is high. This increases the oil flow resistance in a hydraulic circuit and the friction resistance of each slide member, thereby adversely affecting the motions of the hydraulic actuator 60 and hydraulic control valve 66. As a result, a response lag (hereinafter referred to as the "initial response lag") arises between the instant at which the first inching pulse (hereinafter referred to as the "initial pulse") is applied after the start of inching control and the instant at which the actual opening evtex begins to change (the hydraulic actuator 60 begins to move) as indicated within broken-line circle A in FIG. 5. In this instance, the normal inching pulse width calculated according to the map shown in FIG. 6 is insufficient so that the actual opening evtex cannot promptly approach the target value evtext. When the oil temperature is lower than a predetermined judgment temperature, therefore, the present embodiment sets the width of the initial pulse (hereinafter referred to as the "initial pulse width") to be greater than normal inching pulse width (e.g., approximately 100 to 300 msec). The hydraulic actuator 60 can then promptly start moving even when the engine oil temperature is particularly low as shown in FIG. 5. This ensures that the actual opening evtex promptly approaches the target value evtext.

Meanwhile, the engine oil temperature does not readily rise when compared to the engine water temperature. After startup, therefore, the engine oil temperature rises after an increase in the engine water temperature. In other words, the engine oil temperature does not always agree with the engine water temperature for some time after startup. Therefore, it is practically impossible to formulate an accurate judgment when the necessity for an initial pulse width increase is to be determined in accordance with the engine water temperature. However, the present embodiment can formulate an accurate judgment because it determines the necessity for an initial pulse width increase in accordance with the engine oil temperature.

The method of acquiring the engine oil temperature is not specifically defined. Any engine oil temperature acquisition method may be employed. For example, the engine oil temperature may be acquired by directly detecting it with an oil temperature sensor, by estimating it from an automatic transmission oil temperature, or by estimating it from an engine operation history (e.g., cumulative air amount or cumulative number of revolutions).

According to the findings of the inventor of the present invention, the aforementioned initial response lag correlates with the response speed (the gradient of a portion within broken-line circle B in FIG. 5) prevailing after the initial motion of the hydraulic actuator 60. FIG. 7 shows the correlation between the initial response lag and the response speed. As shown in FIG. 7, the greater the initial response lag, the lower the response speed of the hydraulic actuator 60, and the smaller the initial response lag, the higher the response speed of the hydraulic actuator 60.

If, for instance, low-viscosity oil is used, the response speed of the hydraulic actuator 60 is high to some extent even when the engine oil temperature is low. If the initial pulse width is increased in such an instance, the actual opening evtex might significantly overshoot the target value evtext. As such being the case, the present embodiment detects the initial response lag and corrects the increased initial pulse width in accordance with the initial response lag. In other words, if the initial response lag is small, the present embodiment reduces the increased initial pulse width. Further, if the response speed of the hydraulic actuator 60 is high so that the deviation evtexer can be judged to be drastically reduced, the present embodiment forcibly interrupts the initial pulse. This makes it possible to absolutely inhibit the actual opening evtex from overshooting the target value evtext.

In addition, the present embodiment assumes, as described earlier, that the target deviations, which constitute inching control execution conditions, are asymmetrical, that is, 5° CA on the plus side and 15° CA on the minus side. More specifically, since the example shown in FIG. 5 indicates that the target value evtext is 20° CA, inching control is exercised when the actual opening evtex is outside an area between line C (15° CA) and line D (35° CA) in FIG. 5, whereas PD control is exercised when the actual opening evtex is between line C and line D. The use of the above control scheme provides the following advantage.

In contrast to the present embodiment, it is now assumed that line D and line C are in symmetry, that is, at 25° CA. When the actual opening evtex increases and exceeds line C (15° CA), PD control begins with inching control terminated. Subsequently, the actual opening evtex more or less overshoots the target value evtext (20° CA). If, in this instance, line D is at 25° CA, the actual opening evtex is likely to exceed line D. When the actual opening evtex exceeds line D, the control mode switches again from PD control to inching control. As the OCV duty value is then set at 0%, the actual opening evtex drastically decreases. In this manner, inching control and PD control frequently alternate with each other. Therefore, the actual opening evtex might hunt as indicated by a broken line in a comparison example in FIG. 5.

In the present embodiment, on the other hand, line D and line C are not in symmetry. More specifically, line D is set at a position beyond a symmetrical position. Therefore, even when the actual opening evtex overshoots the target value evtext, it is possible to absolutely prevent the actual opening evtex from exceeding line D. Consequently, the control mode does not switch again from PD control to inching control. This makes it possible to absolutely avoid hunting.

Meanwhile, the target value evtext is calculated in principle from the engine speed NE and load rate eklsm in accordance with a map stored in the ECU 50 beforehand. However, the present embodiment limits the target value evtext when the engine oil temperature is low. More specifically, the present embodiment limits the target value evtext to 20° CA when the engine oil temperature is not higher than 5° C., gradually increases the limit value (upper-limit value) for the target value evtext as the engine oil temperature rises when the engine oil temperature is between 5 and 60° C., and lifts the limit on the target value evtext when the engine oil temperature is not lower than 60° C. The use of the above limitation scheme provides the following advantage.

As described earlier, the exhaust variable valve train 54 (hydraulic actuator 60) returns to the most advanced state, which is the initial position, when the engine stops. The exhaust variable valve train 54 includes a lock pin that locks the exhaust camshaft and timing gear 62 in the initial position. When the engine stops, the lock pin moves into its locked position to lock the exhaust camshaft and timing gear 62. This makes it possible to prevent the exhaust camshaft and timing gear 62 from rotating relative to each other when the engine starts up.

However, when the engine oil is low in temperature and high in viscosity, the hydraulic actuator 60 moves at a low speed. Thus, the exhaust variable valve train 54 returns to the initial position at a decreased speed. As a result, the engine oil pressure might decrease before the exhaust variable valve train 54 returns to the initial position, thereby bringing the hydraulic actuator 60 to a stop and preventing the lock pin from moving into its locked position. If the lock pin fails to move into its locked position, the exhaust variable valve train 54 hunts during the next startup.

On the other hand, the present embodiment limits the target value evtext when the engine oil temperature is low. Therefore, the present embodiment can prevent the exhaust variable valve train 54 from moving to a position that is far away from the initial position. This makes it possible to absolutely avoid a situation where the exhaust variable valve train 54 fails to return to the initial position when the engine stops. Thus, the present embodiment can avoid the aforementioned problem.

[Details of Process Performed by First Embodiment]

Figure 8:
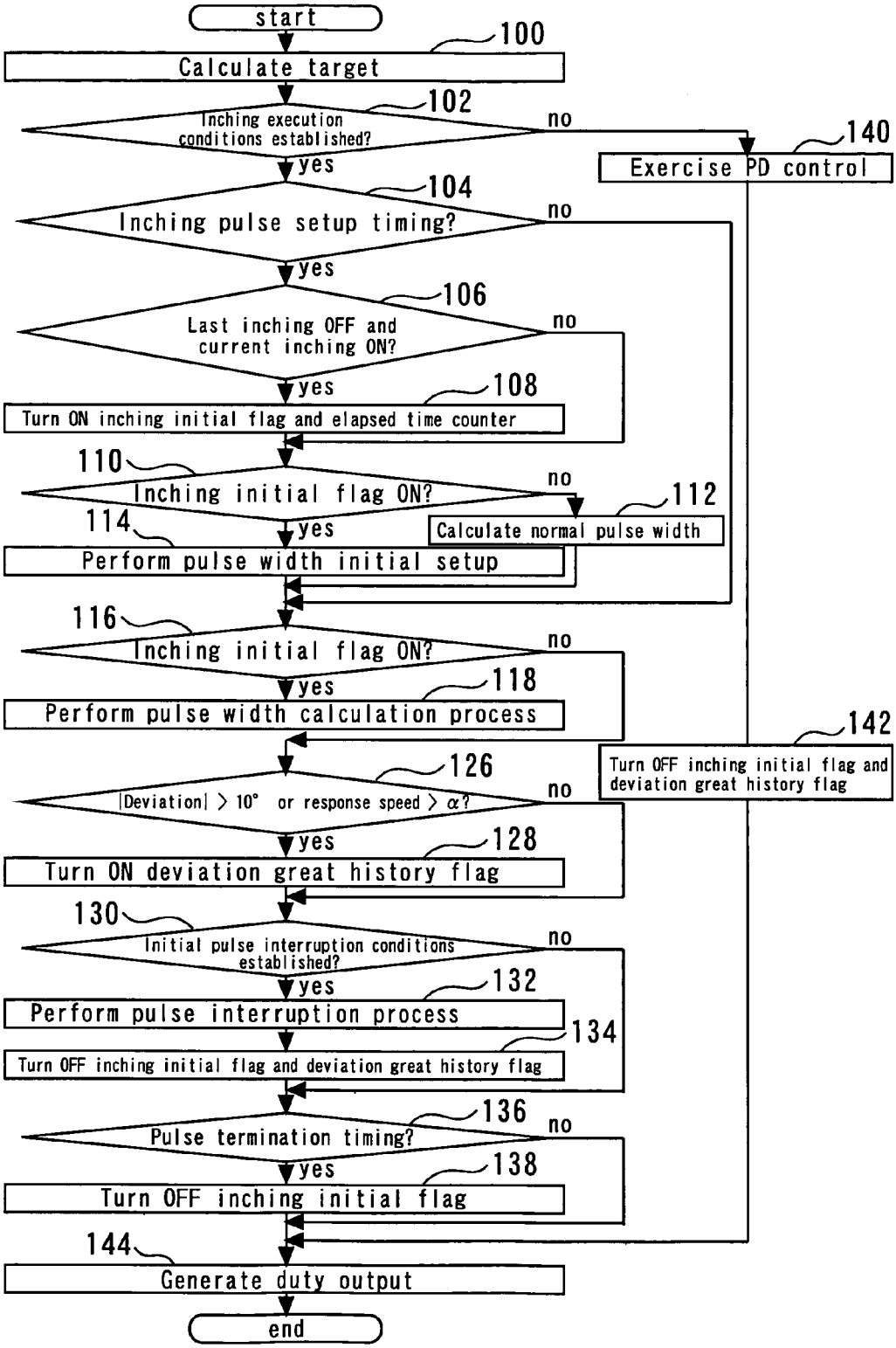
FIG. 8 is a flowchart illustrating a routine that is executed by the first embodiment of the present invention.

FIG. 8 is a flowchart showing a routine that the ECU 50 according to the present embodiment executes to implement the functionality described above. The routine is repeatedly executed at predetermined time intervals. First of all, the routine shown in FIG. 8 performs step 100 to calculate the target value evtext. In step 100, the target value evtext is calculated in accordance with the engine speed NE and load rate eklsm. If the target value evtext is greater than a limit value that is calculated from the engine oil temperature, it is corrected to the limit value.

Next, step 102 is performed to judge whether inching control execution conditions are established. Specifically, if the following two conditions are both met, the routine concludes that the inching control execution conditions are established.

(Condition 1) Deviation evtexer>5° CA or deviation evtexer<−15° CA.

(Condition 2) The engine water temperature is within a predetermined region (e.g., not higher than 60° C.) or inching control is being executed.

If the judgment result obtained in step 102 indicates that the inching control execution conditions are established, step 104 is performed to judge whether inching pulse setup timing has arrived. If the judgment result obtained in step 104 indicates that the inching pulse setup timing has arrived, step 106 is performed to judge whether the inching control execution conditions were not established last time and are established this time. If the query in step 106 is answered "Yes," it can be concluded that the current inching pulse is an initial pulse. In this instance, step 108 is performed to turn ON an inching initial flag, which indicates that the current inching pulse is an initial pulse, and turn ON an elapsed time counter, which counts the initial pulse width.

If the query in step 106 is answered "No" or when the process in step 108 terminates, step 110 is performed to judge whether the inching initial flag is ON. If the inching initial flag is not ON, that is, the current inching pulse is the second or subsequent inching pulse, step 112 is performed to calculate the normal inching pulse width in accordance with the map shown in FIG. 6. If, on the other hand, the judgment result obtained in step 110 indicates that the inching initial flag is ON, step 114 is followed to perform a process for extending the initial pulse width in accordance with the engine oil temperature. In other words, step 114 is performed to compare the engine oil temperature against a predetermined judgment temperature as described earlier. If the engine oil temperature is lower than the judgment temperature, the initial pulse width is set to be greater than the normal inching pulse width (e.g., set at a value between 100 and 300 msec).

Figure 9:
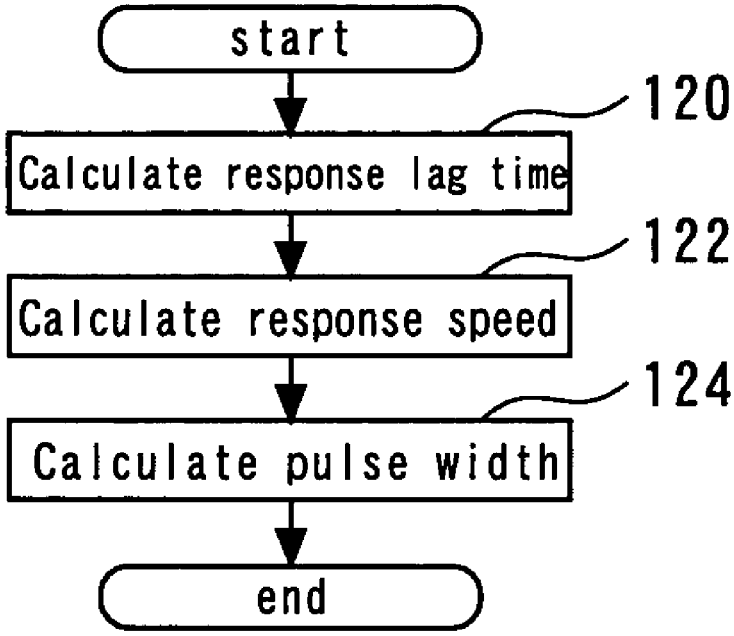
FIG. 9 is a flowchart illustrating a routine that is executed by the first embodiment of the present invention.

If the judgment result obtained in step 104 indicates that the inching pulse setup timing has not arrived, or when the process in step 112 or 114 terminates, step 116 is performed to judge again whether the inching initial flag is ON. If the inching initial flag is judged to be ON, step 118 is followed to perform a process for correcting the initial pulse width in accordance with the initial response lag. FIG. 9 is a flowchart showing how a subroutine performs the process in step 118. The subroutine first performs step 120 to calculate initial response lag time. The initial response lag time is calculated by determining the time interval between the instant at which the elapsed time counter is turned ON in step 108 and the instant at which the initial motion of the hydraulic actuator 60 is detected by the exhaust cam angle sensor 58. Next, step 122 is performed to calculate (estimate) the response speed of the hydraulic actuator 60 in accordance with the initial response lag time and the map shown in FIG. 7. Step 124 is then performed to correct the initial pulse width in accordance with the response speed. More specifically, the initial pulse width calculated in step 114 is reduced so that the initial pulse width decreases with an increase in the response speed.

If the judgment result obtained in step 116 indicates that the inching initial flag is not ON, or when the process in step 118 (FIG. 9) terminates, step 126 is performed to judge whether the absolute value of the deviation evtexer is greater than 10° CA or whether the response speed of the hydraulic actuator 60 is higher than a predetermined judgment value α. If either of these queries is answered "Yes," step 128 is performed to turn ON a deviation great history flag.

When the query in step 126 is answered "No" or when the process in step 128 terminates, step 130 is performed to judge whether initial pulse interruption conditions are established. Specifically, if all the following four conditions are met, the routine concludes that the initial pulse interruption conditions are established.

(Condition 1) The initial pulse is extended.

(Condition 2) The inching initial flag is ON.

(Condition 3) The deviation great history flag is ON.

(Condition 4) The absolute value of the deviation evtexer is smaller than 10° CA.

If the above four initial pulse interruption conditions are judged to be met, the deviation evtexer is drastically reduced. It can therefore be concluded that the initial pulse should be interrupted to suppress an overshoot. In this instance, step 132 is followed to perform a process for interrupting the initial pulse. Next, step 134 is performed to turn OFF both the inching initial flag and deviation great history flag.

If the query in step 130 is answered "No" or when the process in step 134 terminates, step 136 is performed to judge whether inching pulse termination timing has arrived. If the inching pulse termination timing has arrived, step 138 is performed to turn OFF the inching initial flag.

If, on the other hand, the judgment result obtained in step 102 indicates that the inching execution conditions are not established, step 140 is performed to exercise PD control. More specifically, the OCV duty value edvtex is calculated in accordance with the deviation evtexer. Next, step 142 is performed to turn OFF both the inching initial flag and deviation great history flag.

If the query in step 136 is answered "No" or when the process in step 138 or 142 terminates, step 144 is performed to output a control signal based on the OCV duty value edvtex to the hydraulic control valve 66. In this instance, either the forced drive duty value or retention duty value is used as the OCV duty value edvtex while inching control is being exercised. While PD control is being exercised, however, the value calculated in step 140 is used as the OCV duty value edvtex.

The first embodiment, which has been described above, assumes that the present invention is applied to the control of a variable valve timing mechanism that varies the valve open/close timing while maintaining a fixed operating angle (valve opening period). However, the present invention can also be applied to the control of various other variable valve trains (e.g., a variable valve train that continuously varies the operating angle).

In the first embodiment, which has been described above, the "duty value feedback control means" according to the first aspect of the present invention is implemented when the ECU 50 performs step 140; the "inching control means" according to the first aspect of the present invention is implemented when the ECU 50 executes the routine shown in FIG. 8; the "initial pulse extension means" according to the first aspect of the present invention is implemented when the ECU 50 performs step 114; the "actuator responsiveness acquisition means" according to the second aspect of the present invention is implemented when the ECU 50 performs steps 120 and 122; the "initial pulse width correction means" according to the second aspect of the present invention is implemented when the ECU 50 performs step 124; and the "limitation means" according to the fourth aspect of the present invention is implemented when the ECU 50 performs step 100.

The invention claimed is:

1. A variable valve train control device comprising:

a variable valve train which uses a hydraulic actuator to vary a valve opening characteristic of an intake valve or an exhaust valve of an internal combustion engine;

oil temperature acquisition means for detecting or estimating an oil temperature;

a hydraulic control valve for controlling oil pressure acting on the hydraulic actuator in accordance with a duty value of a control signal;

first feedback control means for exercising duty value feedback control to calculate a duty value in accordance with a deviation between an actual valve opening characteristic and a target valve opening characteristic;

second control means which, when predefined second control execution conditions are established, exercises second control instead of the duty value feedback control to vary the duty value in a pulsed manner between a retention duty value, which retains an operation of the hydraulic actuator, and a forced drive duty value, which forcibly drives the hydraulic actuator;

initial pulse extension means which, when the oil temperature is lower than a predetermined temperature, ensures that the initial pulse width generated after the start of the second control is wider than normal;

initial response lag acquisition means for acquiring a response lag between the instant at which the initial pulse of the second control rises and the instant at which the hydraulic actuator starts operating; and initial pulse width correction means which, when the response lag is shorter than a predetermined period of time, shortens the initial pulse that is set by the initial pulse extension means.

2. The variable valve train control device according to claim 1, wherein one of the second control execution conditions requires that the deviation be greater than a predetermined target deviation, and wherein the absolute value of a target deviation for a plus deviation differs from the absolute value of a target deviation for a minus deviation.

3. The variable valve train control device according to claim 1, further comprising:

limitation means which, when the oil temperature is lower than a predetermined temperature, limits the amount of operation from an initial position of the hydraulic actuator.

4. A variable valve train control device comprising:

a variable valve train which uses a hydraulic actuator to vary a valve opening characteristic of an intake valve or an exhaust valve of an internal combustion engine;

an oil temperature acquisition device for detecting or estimating an oil temperature;

a hydraulic control valve for controlling oil pressure acting on the hydraulic actuator in accordance with a duty value of a control signal;

a first feedback control device for exercising duty value feedback control to calculate a duty value in accordance with a deviation between an actual valve opening characteristic and a target valve opening characteristic;

a second control device which, when predefined second control execution conditions are established, exercises second control instead of the duty value feedback control to vary the duty value in a pulsed manner between a retention duty value, which retains an operation of the hydraulic actuator, and a forced drive duty value, which forcibly drives the hydraulic actuator, an initial pulse extension device which, when the oil temperature is lower than a predetermined temperature, ensures that the initial pulse width generated after the start of the second control is wider than normal;

an initial response lag acquisition device for acquiring a response lag between the instant at which the initial pulse of the second control rises and the instant at which the hydraulic actuator starts operating; and an initial pulse width correction device which, when the response lag is shorter than a predetermined period of time, shortens the initial pulse that is set by the initial pulse extension device.

5. The variable valve train control device according to claim 4, wherein one of the second control execution conditions requires that the deviation be greater than a predetermined target deviation, and wherein the absolute value of a target deviation for a plus deviation differs from the absolute value of a target deviation for a minus deviation.

6. The variable valve train control device according to claim 4, further comprising:

a limitation device which, when the oil temperature is lower than a predetermined temperature, limits the amount of operation from an initial position of the hydraulic actuator.

* * * * *